US010356870B2

(12) United States Patent
Aliakseyeu et al.

(10) Patent No.: US 10,356,870 B2
(45) Date of Patent: Jul. 16, 2019

(54) CONTROLLER FOR CONTROLLING A LIGHT SOURCE AND METHOD THEREOF

(71) Applicant: SIGNIFY HOLDING B.V., Eindhoven (NL)

(72) Inventors: Dzmitry Viktorovich Aliakseyeu, Eindhoven (NL); Bartel Marinus Van De Sluis, Eindhoven (NL); Tim Dekker, Eindhoven (NL); Dirk Valentinus René Engelen, Heusden-Zolder (BE); Philip Steven Newton, Waqalre (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/776,099

(22) PCT Filed: Nov. 15, 2016

(86) PCT No.: PCT/EP2016/077683

§ 371 (c)(1),
(2) Date: May 15, 2018

(87) PCT Pub. No.: WO2017/085046

PCT Pub. Date: May 26, 2017

(65) Prior Publication Data

US 2018/0324921 A1 Nov. 8, 2018

(30) Foreign Application Priority Data

Nov. 16, 2015 (EP) ..... 15194643

(51) Int. Cl.
*H05B 33/08* (2006.01)
*G09G 3/34* (2006.01)

(52) U.S. Cl.
CPC ..... *H05B 33/0863* (2013.01)

(58) Field of Classification Search
CPC .. H05B 33/08; H05B 33/086; H05B 33/0863; H05B 33/0842; H05B 37/02;
(Continued)

(56) References Cited

U.S. PATENT DOCUMENTS

2005/0248299 A1* 11/2005 Chemel ..... H05B 37/029 315/312
2006/0132482 A1 6/2006 Oh
(Continued)

FOREIGN PATENT DOCUMENTS

WO 2008129505 A1 10/2008
WO 2008142603 A2 11/2008
(Continued)

OTHER PUBLICATIONS

Zhunping Zhang, et al., "Feature-Based Lighting Field Morphing," Microsoft Research Asia, 2002 (8 pages).

*Primary Examiner* — Thai Pham
(74) *Attorney, Agent, or Firm* — Akarsh P. Belagodu

(57) ABSTRACT

A controller 100 for controlling a light source 110 is disclosed. The controller 100 comprises a communication unit 102 for communicating with the light source 100. The controller 100 further comprises an input unit 104 for receiving a first input indicative of a selection of a first color in a first image, and for receiving a second input indicative of a selection of a second color in a second image. The controller 100 further comprises a processor 106 for morphing the first image into the second image after the first and second user input have been received, whereby at least one intermediate image in between the first image and the second image is generated, the at least one intermediate image being a mixture of the first image and the second image, and for determining at least one intermediate color based on color information of the at least one intermediate image. The processor 106 is further arranged for controlling
(Continued)

the light output of the light source 110 according to the first color, the at least one intermediate color and the second color sequentially over a period of time, by communicating the first color, the at least one intermediate color and the second color to the light source.

14 Claims, 7 Drawing Sheets

(58) Field of Classification Search
CPC ..... H05B 37/0245; H05B 37/0272; H05B 37/0263; G09G 3/34; G09G 3/3413; G09G 3/342
See application file for complete search history.

(56) References Cited

U.S. PATENT DOCUMENTS

2009/0290326 A1* 11/2009 Tiedje ..... H05B 33/0863 362/85
2011/0022396 A1* 1/2011 Van De Sluis .... H05B 37/0236 704/275
2011/0273114 A1* 11/2011 Ogg ..... H05B 37/029 315/312
2015/0022123 A1* 1/2015 Van De Sluis .... H05B 37/0245 315/312

FOREIGN PATENT DOCUMENTS

WO 2011013035 A1 2/2011
WO 2013121311 A1 8/2013

* cited by examiner

CONTROLLER FOR CONTROLLING A LIGHT SOURCE AND METHOD THEREOF

CROSS-REFERENCE TO PRIOR APPLICATIONS

This application is the U.S. National Phase application under 35 U.S.C. § 371 of International Application No. PCT/EP2016/077683, filed on Nov. 15, 2016, which claims the benefit of European Patent Application No. 15194643.1, filed on Nov. 16, 2015. These applications are hereby incorporated by reference herein.

FIELD OF THE INVENTION

The invention relates to a controller for controlling a light source. The invention further relates to a method of controlling a light source. The invention further relates to a computer program product for performing the method.

BACKGROUND

Future and current home and professional environments will contain a large number of lighting devices for creation of ambient, atmosphere, accent or task lighting. These controllable lighting devices may be controlled via user interface of a remote control device, for example a smartphone, via a (wireless) network. An example of such a user interface is disclosed in patent application WO 2013121311 A1, which discloses a remote control unit that comprises a user interface through which a user may identify an area in an image and a light source. The identified image area is linked with the light source and color information of the identified image area is transmitted to the light source. The light source is thereby enabled to adapt its light output to the color information. A user is thereby enabled to pick the color to be outputted by a light source by selecting an area in an image displayed on the remote control unit. This allows the user to create a static light effect. However, users also desire to create dynamic light effects. A dynamic light effect comprises a plurality of light settings that change over time when applied to a (set of) lighting device(s), in other words, a dynamic light effect has a time dependent light output. Thus, there is a need in the art for a user interface which allows a user to create a dynamic light effect.

International patent application WO 2008142603 A2 relates to a lighting system comprising a user interface configured to display an image of an environment including an object provided with a first illumination and a processor configured to change the first illumination to a second illumination in response to a signal and to select at least one light source to provide the second illumination based on attributes of the second illumination and availability and specifications of the light source.

SUMMARY OF THE INVENTION

It is an object of the present invention to provide a controller that allows a user to create a dynamic light effect. It is a further object of the present invention to provide a user interface that allows user to control parameters of the dynamic light effect.

According to a first aspect of the present invention, the object is achieved by a controller for controlling a light source, the controller comprising:

a communication unit for communicating with the light source, an input unit for receiving a first input indicative of a selection of a first color in a first image, and for receiving a second input indicative of a selection of a second color in a second image, and a processor for morphing the first image into the second image after the first and second user input have been received, whereby at least one intermediate image in between the first image and the second image is generated, the at least one intermediate image being a mixture of the first image and the second image, and for determining at least one intermediate color based on color information of the at least one intermediate image, and for controlling the light output of the light source according to the first color, the at least one intermediate color and the second color sequentially over a period of time, by communicating the first color, the at least one intermediate color and the second color to the light source.

The controller for example allows a user to select a first color in a first image and a second color in a second image, whereupon the processor determines how the first color changes into the second color, based on color information from one or more intermediate images. The processor is further arranged for controlling the light output of the light source according to the colors over time. This provides the advantage that it allows a user to create a dynamic light effect (a time dependent light output), simply by selecting the first color and the second color in the two images.

In an embodiment of the controller, the controller further comprises a display arranged for displaying the morphing of the first image and the first color into the second image and the second color over time. In a further embodiment of the controller, the processor is further arranged for providing, on the display, a graphical representation of the light source in the first, the at least one intermediate and the second image, wherein the graphical representation of the light source is located at the first, the at least one intermediate and the second color, respectively. This embodiment is advantageous because the graphical representations shown on the display (for example the display of a smartphone) allows a user to see how the first color is morphed into the second color based on the color information of the intermediate images.

In a further embodiment of the controller, the input unit is further arranged for receiving user input related to a repositioning of the graphical representation in the first, the at least one intermediate and/or the second image, which repositioning is representative of a selection of the color of the first, the at least one intermediate and/or the second image, respectively. This is advantageous because it allows the user to control/adjust the dynamic light effect at the start (the first image), in between (the one or more intermediate images) and at the end (the second image).

In an embodiment of the controller, the first color is associated with a first set of coordinates in the first image, and the second color is associated with a second set of coordinates in the second image, and the processor is further arranged for:

determining a path which starts at the first set of coordinates and ends at the second set of coordinates, determining an intermediate set of coordinates on the path in the at least one intermediate image, and determining the at least one intermediate color based on color information at the intermediate set of coordinates in the at least one intermediate image.

In a further embodiment of the controller, the input unit is further arranged for receiving user input related to a repositioning of at least a part of the path. This is beneficial because it allows the user to control/adjust the dynamic light effect, simply by repositioning the path, whereupon the processor determines the at least one new intermediate color based on color information at the new intermediate set of coordinates in the at least one intermediate image.

In an embodiment of the controller, the input unit is arranged for receiving color information of a light setting from the light source as the first input, and the processor is arranged for selecting the first color in the first image based on the received color information, such that the first color corresponds at least partially to the color information. This is beneficial because it allows the processor to determine the colors based on, for example, an active light setting of the light source. The active light setting may, for example, be a red light, which results in that the processor looks for a red color in the first image and sets the (location of the) red color in the first image as the first color. This further allows the processor to map, for example, the graphical representation of the light source onto that selected color.

In an embodiment of the controller, the input unit is arranged for receiving user input related to the selection of the first color in the first image and/or the selection of the second color in the second image. This allows a user to select a first color in a first image and a second color in a second image, whereupon the processor determines how the first color changes into the second color, based on color information from one or more intermediate images. In a further embodiment of the controller, the input unit is further arranged for receiving user input related to a selection of the first image and/or the second image from a plurality of images.

According to a second aspect of the present invention, the object is achieved by a method of controlling a light source, the method comprising the steps of:

a. receiving a first input indicative of a selection of a first color in a first image, b. receiving a second input indicative of a selection of a second color in a second image, c. morphing the first image into the second image after the first and second user input have been received, whereby at least one intermediate image in between the first image and the second image is generated, the at least one intermediate image being a mixture of the first image and the second image, d. determining at least one intermediate color based on color information of the at least one intermediate image, and e. controlling the light output of the light source according to the first color, the at least one intermediate color and the second color sequentially over a period of time, by communicating the first color, the at least one intermediate color and the second color to the light source.

In an embodiment of the method, the method further comprises the step of providing a graphical representation of the light source in the first, the at least one intermediate and the second image, wherein the graphical representation of the light source is located at the first, the at least one intermediate and the second color, respectively. Additionally, the method may comprise the step of receiving a user input related to a repositioning of the graphical representation in the first, the at least one intermediate and/or the second image, which repositioning is representative of a selection of the color of the first, the at least one intermediate and/or the second image, respectively.

In an embodiment of the method, step a. comprises receiving a first user input as the first input, and step b. comprises receiving a second user input as the second input.

According to a third aspect of the present invention, the object is achieved by a computer program product for a computing device, the computer program product comprising computer program code to perform any of the above-mentioned methods when the computer program product is run on a processing unit of the computing device.

BRIEF DESCRIPTION OF THE DRAWINGS

The above, as well as additional objects, features and advantages of the disclosed controllers and methods, will be better understood through the following illustrative and non-limiting detailed description of embodiments of devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
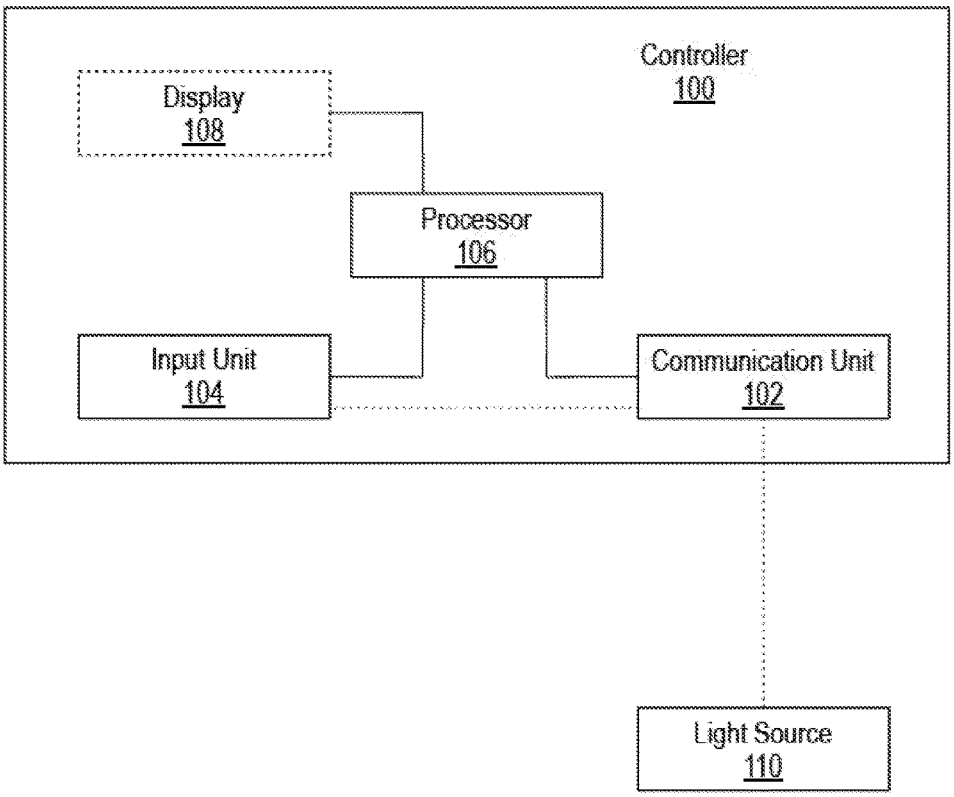
FIG. 1 shows schematically an embodiment of a controller according to the invention for controlling a light source.

FIG. 1 shows schematically an embodiment of a controller 100 according to the invention for controlling a light source 110. The controller 100 comprises a communication unit 102 for communicating with the light source 110. The light source 110 may be for example an LED light source comprised in a lighting device or a luminaire. The controller 100 further comprises an input unit 104 for receiving a first input indicative of a selection of a first color in a first image, and for receiving a second input indicative of a selection of a second color in a second image. The controller 100 further comprises a processor 106 for morphing the first image into the second image, whereby at least one intermediate image in between the first image and the second image is generated, the at least one intermediate image being a mixture of the first image and the second image, and for determining at least one intermediate color based on color information of the at least one intermediate image. The processor 106 is further arranged for controlling the light output of the light source 110 according to the first color, the at least one intermediate color and the second color sequentially over a period of time by communicating the first color, the at least one intermediate color and the second color to the light source 110.

The light source 110 may comprise an LED light source, an incandescent light source, a fluorescent light source, a high-intensity discharge light source, etc. The light source 110 may be arranged for providing general lighting, task lighting, ambient lighting, atmosphere lighting, accent lighting, indoor lighting, outdoor lighting, etc. The light source 110 may be installed in a luminaire or in a lighting fixture. Alternatively, the light source 110 may be comprised in a portable lighting device (e.g. a hand-sized device, such as an LED cube, an LED sphere, an object/animal shaped lighting device, etc.) or in a wearable lighting device (e.g. a light bracelet, a light necklace, etc.).

The controller 100 may be any type of control device arranged for communicating with light sources/lighting devices. The controller may be a smart device, such as a smartphone or a tablet, or the controller may be a wearable device, such as smart glasses or a smart watch. Alternatively, the controller may be comprised in a building automation system, be comprised in a lighting device, luminaire, etc. The communication unit 102 of the controller 100 is arranged for communicating with the light source 110. The communication unit 102 may be arranged for communicating with the light source 110 directly, or via any intermediate device (such as a hub, a bridge, a proxy server, etc.). The communication unit 102 may transmit lighting control commands (for example as signals, messages, data packets, etc.) to a receiver of a lighting device comprising light source 110 in order to control the light output of the light source 110. The communication unit 102 may be further arranged for receiving signals/messages/data packets from the lighting device comprising the light source 110. These received signals/messages/data packets may, for example, relate to an (active) light setting of the light source 110, the type of light source 110, the properties of the light source 110, etc. The communication unit 102 may transmit/receive messages, signals or data packets via any communication protocol (e.g. Wi-Fi, ZigBee, Bluetooth, 3G, 4G, LTE, DALI, DMX, USB, power over Ethernet, power-line communication, etc.). It may be beneficial if the controller 100 is arranged for communicating via a plurality of communication channels/protocols, thereby enabling the transmission/reception of messages, signals or data packets to/from a plurality of types of lighting devices.

Figure 2:
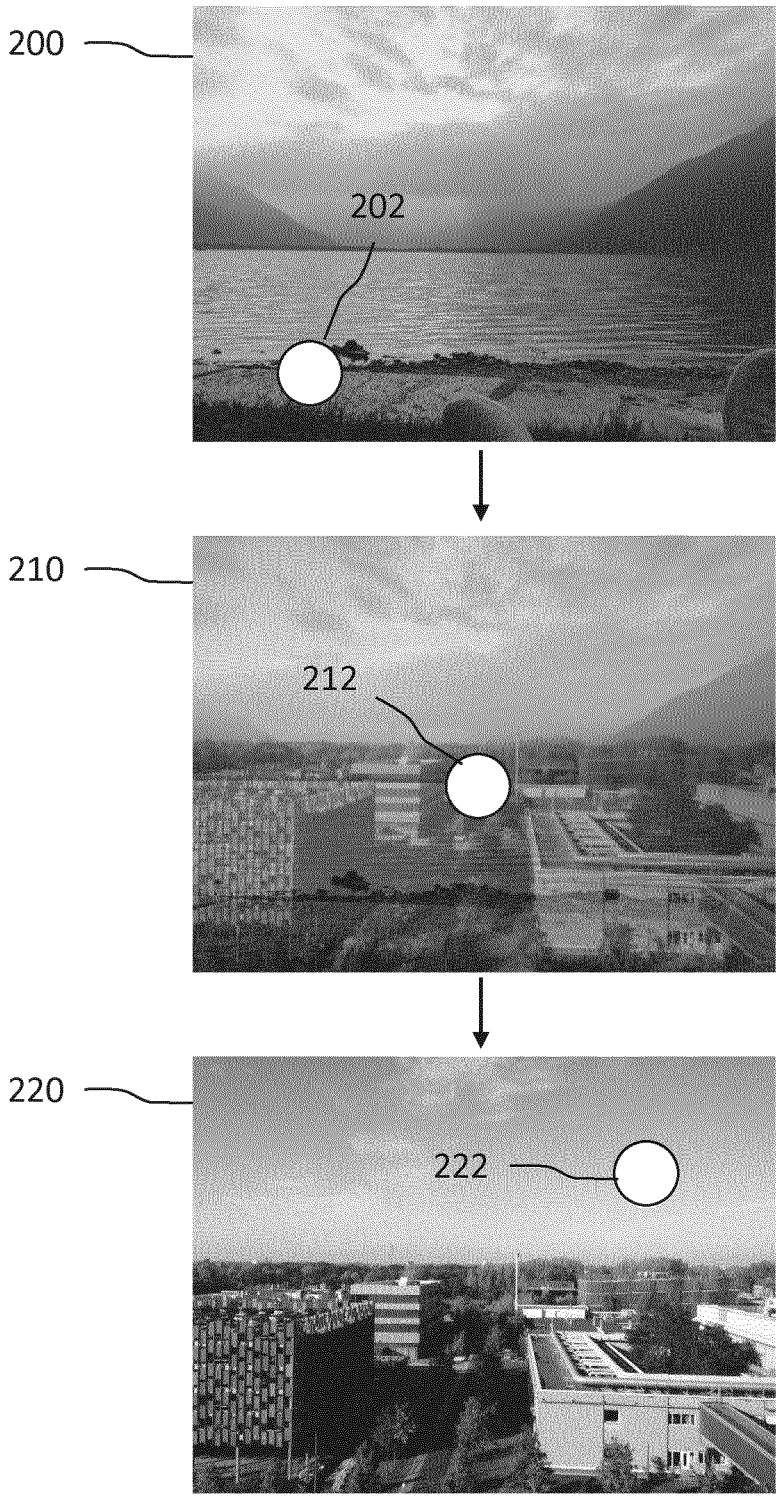
FIG. 2 shows an example of morphing a first image into a second image.

The processor 106 (a microchip, circuitry, a microcontroller, etc.) is arranged for morphing the first image into the second image in order to generate the at least one intermediate image. FIG. 2 shows an example of morphing a first image 200 into a second image 220. The morphing creates a smooth transformation 200 of the first image into the second image 220, thereby generating at least one intermediate image 210. As shown in FIG. 2, the intermediate image 210 is a mixture of the first image 200 and the second image 220. The processor 106 is further arranged for determining the at least one intermediate color based on color information of the at least one intermediate image. The at least one intermediate color may be based on, for example, an average color value of the pixels of the intermediate image, be based on a most prominent pixel color of the intermediate image, be based on colors of pixels located at a location in between the locations of pixels of the first color and the second color in de first image and the second image, respectively, etc. The processor 106 is arranged for providing a gradual transition (over time) from the first color, via the at least one intermediate color to the second color. The processor 106 may be arranged for generating a plurality of intermediate images in between the first and the second image in order to provide a plurality intermediate colors. Multiple intermediate colors may result in a more gradual transition from the first color to the second color.

The controller 100 may further comprise a display 108 arranged for displaying the first image and the second image, which allows a user to see the first selected color on the first image and the second selected color on the second image. The processor 106 may be further arranged for providing, on the display 108, one or more intermediate images, which allows a user to see how the first image and the first color are morphed into the second image and the second color.

The processor 106 may be further arranged for providing, on the display 108, a graphical representation of the light source in the first, the at least one intermediate and the second image, wherein the graphical representation of the light source is located at the first, the at least one intermediate and the second color, respectively. FIG. 2 shows an example of such a graphical representation. Graphical representation 202 of the light source in the first image 200 is indicative of the first color. Intermediate graphical representation 212 of the light source in the intermediate image 210 is indicative of the intermediate color. Graphical representation 222 of the light source in the second image 220 is indicative of the second color. The first, intermediate and second color may, for example, be determined by the processor 106 by taking an average color value of the pixel values associated with the area covered by the virtual representation. In the example of FIG. 2, the intermediate graphical representation 212 is located at a location in between a location of the graphical representation 202 and a location of the graphical representation 222. This allows a user to see the first, the at least one intermediate and the second color, and thereby how the first color is morphed into the second color.

Figure 4:
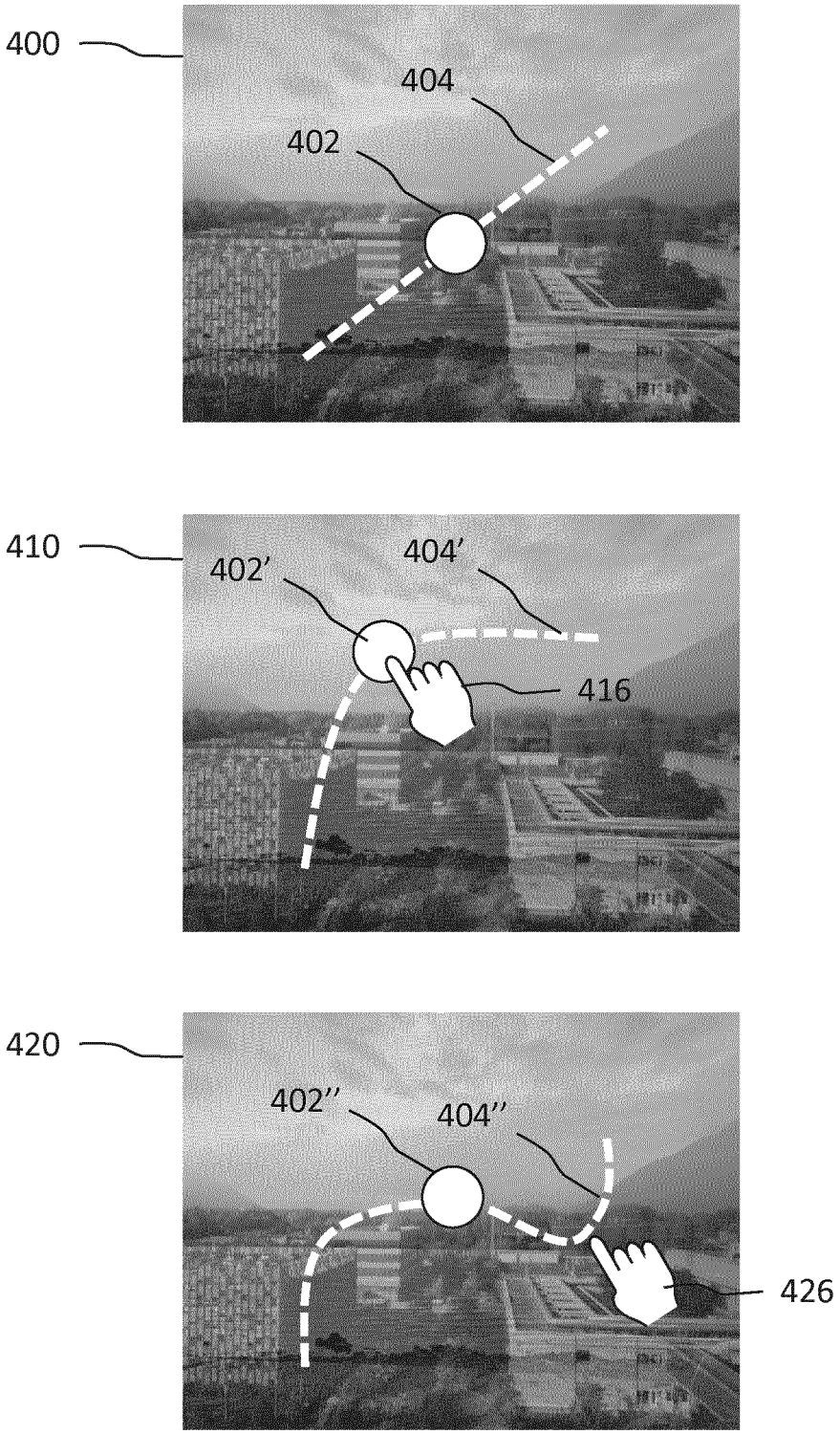
FIG. 4 shows examples of intermediate images comprising paths comprising control points, which paths and control points may be repositioned by a user.

The input unit 104 may be arranged for receiving user input related to a repositioning of the graphical representation in the first, the at least one intermediate and/or the second image, which repositioning is representative of a selection of the color of the first, the at least one intermediate and/or the second image, respectively. The input unit 104 may, for example, comprise a touch sensitive display which displays the graphical representation in the first, the at least one intermediate and/or the second image. A user may reposition a graphical representation from a first location associated with one or more first pixels associated with one or more first color values to a second location associated with one or more second pixels associated with one or more second color values. An example of such a repositioning is shown in FIG. 4. FIG. 4 shows a top image 400 of an intermediate image with graphical representation 402, and a center image 410, wherein a user provides a user input 416 to reposition the graphical representation 402' and thereby selects a new color (the color information at the location of the graphical representation). Additionally or alternatively, the input unit 104 may be arranged for receiving a user input related to a reshaping and/or resizing of the graphical representation. This allows a user to select, for example, an area the first image, an area in the at least one intermediate image and/or an area in the second image, from which the processor 106 may calculate the average pixel color value in order to determine a first, at least one intermediate or a second color, respectively.

The input unit 104 is arranged for receiving a first input indicative of a selection of a first color in a first image, and for receiving a second input indicative of a selection of a second color in a second image. The first and second input may be selections of a first area/location in the first image and a selection of a second area/location in the second image, which areas/locations determine the first and second color. Alternatively, the first input may be a first signal indicative of first color information, and/or the second input may be a second signal indicative of second color information, which first and second color information may be descriptive of properties of a color (e.g. an RGB value, a hue/saturation/brightness value, etc.). The processor 106 may be arranged for determining a first area/location in the first image of which the pixels have color values similar to the received first color information, and/or a second area/location in the second image of which the pixels have color values similar to the received second color information.

The input unit 104 may be arranged for receiving the first and second input from a further device. The first and second input may be received by the communication unit from the further device. The input unit may, for example, be arranged for receiving color information (color values) of a light setting from the light source as the first input, and the processor 106 may be arranged for selecting the first color in the first image based on the received color information, such that the first color corresponds at least partially to the color information. The processor 106 may be further arranged for analyzing the color information of the light setting (for example a green color with a high saturation and a low intensity), whereupon the processor 106 may analyze the first image and map the light setting on the first image, for example by providing a graphical representation of the light source at a location in the first image of which the color of the pixel(s) has sufficient similarities with the received color of the light setting.

Additionally or alternatively, the input unit 104 may, for example, comprise a user interface arranged for receiving the first and/or the second input. The user interface may comprise a touch sensitive surface, for example a touch screen, which may be arranged for receiving a first touch input indicative of the selection of the first color in the first image and for receiving a second touch input indicative of the selection of the second color in the second image. Alternatively, the user interface may comprise a pointing device, such as a computer mouse or a stylus pen, which may be operated by the user in order to provide the first and second input. Alternatively, the user interface for example comprise an audio sensor such as a microphone, a motion sensor such as an accelerometer, magnetometer and/or a gyroscope for detecting gestures, a camera for detecting gestures and/or one or more buttons for receiving the first and second input.

Figure 3:
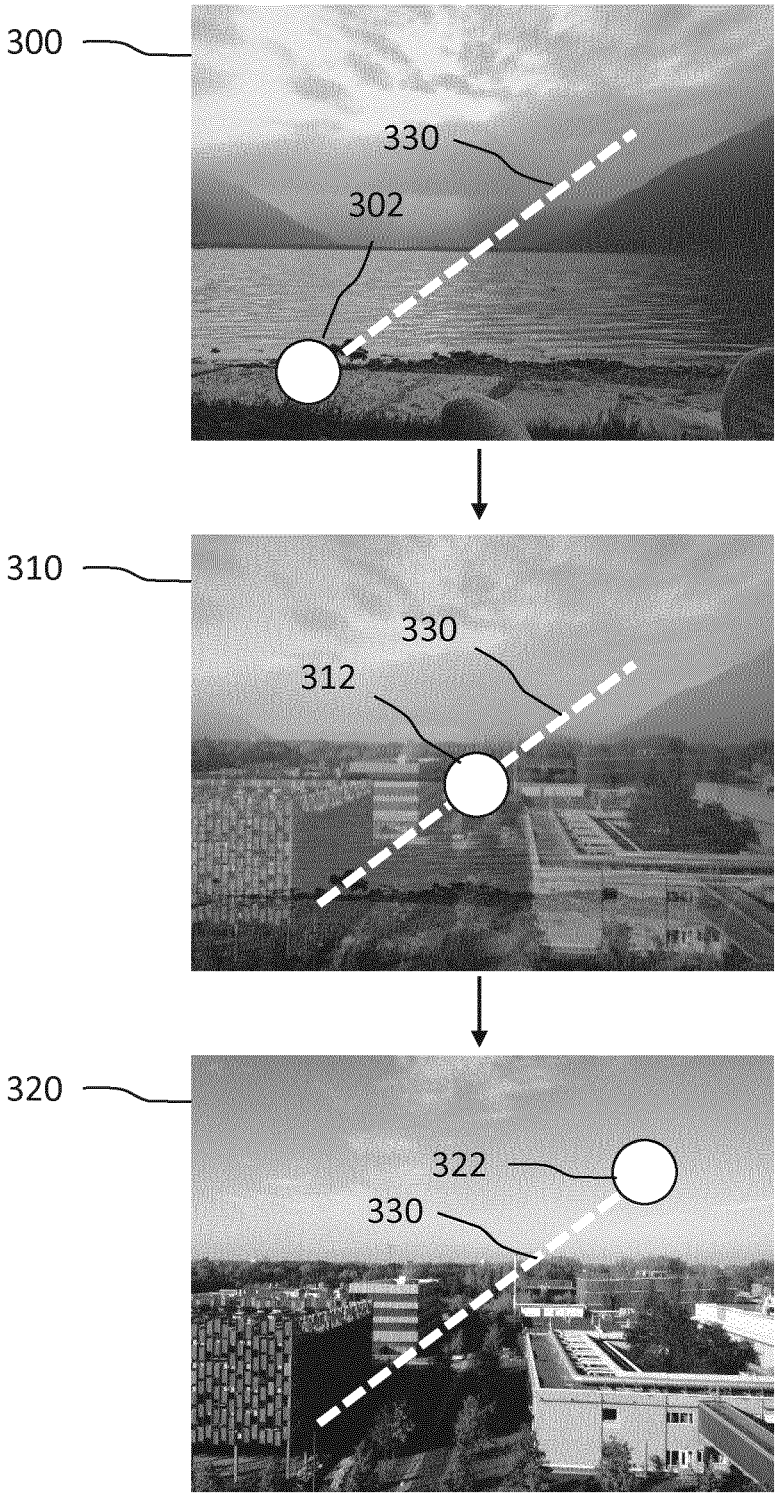
FIG. 3 shows an example of morphing a first image into a second image, and a path along which the color changes.

The processor 106 may be further arranged for determining a path which starts at a first set of coordinates in the first image associated with the first color and ends at a second set of coordinates in the second image associated with the second color, and for determining an intermediate set of coordinates on the path in the at least one intermediate image, and for determining the at least one intermediate color based on color information at the intermediate set of coordinates in the at least one intermediate image. The intermediate set of coordinates may be located on a linear path from the first to the second set of coordinates. Alternatively, the processor may be arranged for determining the path (and therewith the intermediate set of coordinates) based on color information (pixel color value information) of the one or more intermediate images in order to realize a gradual transition from the first color to the second color. FIG. 3 shows an example of the generation of a linear path 330 from the first set of coordinates of the first selected color 302 in the first image 300 to the second set of coordinates of the second selected color 322 in the second image 320. This linear path determines the selection of the set(s) of coordinates in the at least one intermediate image 310, and therewith the intermediate color 312. In FIG. 3, the transition from the first color located at the first set of coordinates, for example at location (3,9), into the second color located at the second set of coordinates, for example (8,2), occurs along the linear path starting at (3,9) and ending at (8,2). Therefore, the one or more intermediate colors are based on the pixel color values of the coordinates on the path in the one or more intermediate images (i.e. the mixture of the first and the second image).

The input unit 104 may be further arranged for receiving user input related to a repositioning of at least a part of the path. An example of such a repositioning is shown in FIG. 4. FIG. 4 shows a top image 400 of an intermediate image and a graphical representation of the path 404, and a lower image 420, wherein a user provides a user input 426 to reposition the graphical representation of the path 404". The user thereby selects new intermediate colors (for example intermediate color 402") which are based on the pixel color values of the coordinates on the new path 404" in the one or more intermediate images 420.

The input unit 104 may be further arranged for receiving user input related to a selection of the first image and/or the second image from a plurality of images. The images may be stored on a memory, and the processor may be further arranged for accessing the memory, retrieving the images and displaying the images on a display of the controller. The user input unit may, for example, comprise a touch sensitive display for receiving a touch input which is indicative of a selection of the first and/or second image. Additionally or alternatively, the input unit 104 may be arranged for receiving user input related to a selection of a third image. The processor 106 may be arranged for morphing the first image into the second image via the third image, thereby generating at least two intermediate images; a first intermediate image which is a mixture of the first and the third image, and a second intermediate image which is a mixture of the second and the third image. Selecting multiple images to create the dynamic light effect provides a user more detailed control of the creation of the dynamic light effect.

The input unit 104 may further be arranged for receiving a user input related to an adjustment of the period of time. This allows a user to determine, for example, a duration of the dynamic light effect, if and how the dynamic effect is looped, whether the sequential control of the light output of the light source 102 occurs linearly or exponentially, etc.

Figure 5:
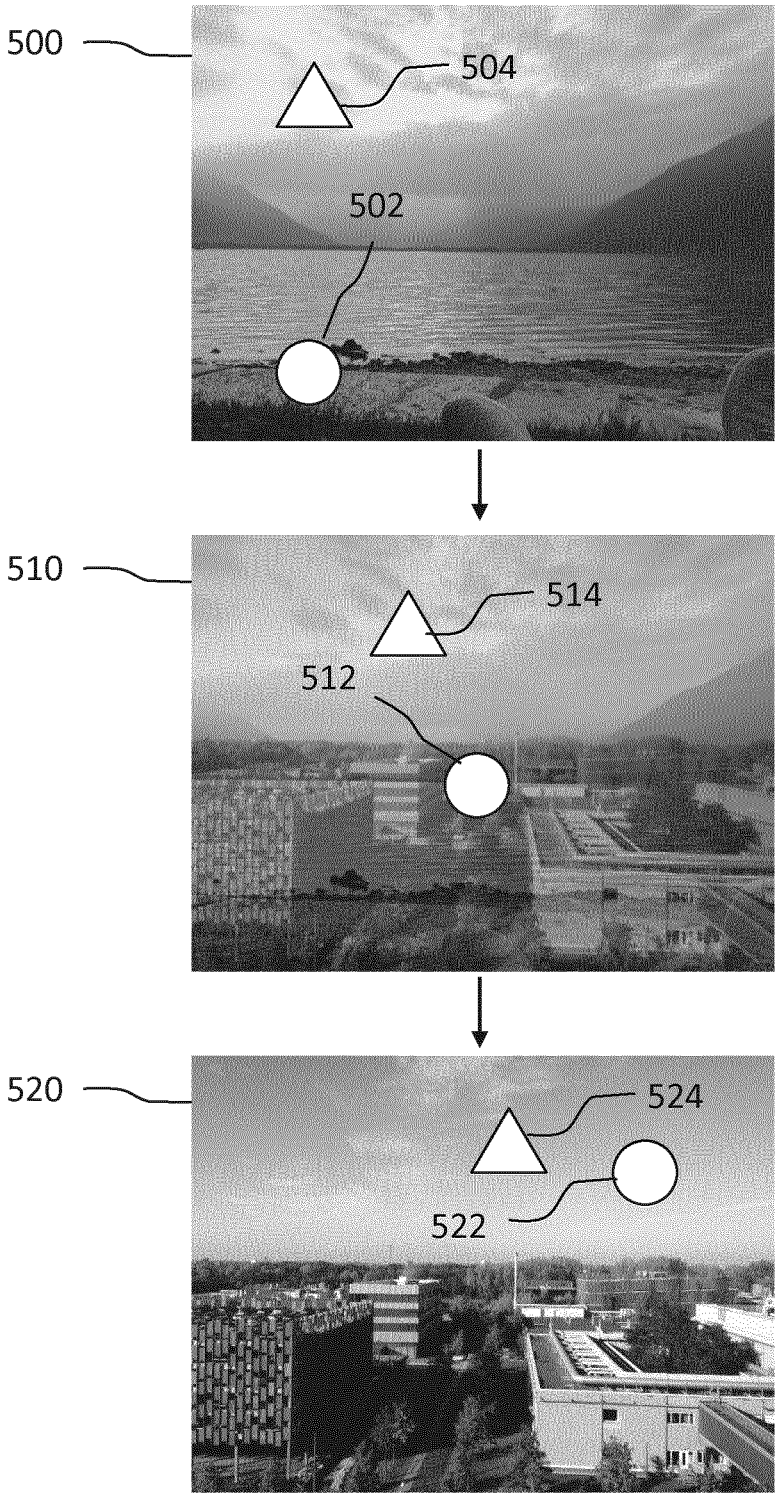
FIG. 5 shows an example of morphing a first image into a second image, and a graphical representation of a first and a second light source.

The controller 100 may be further arranged for controlling a plurality of light sources. FIG. 5 illustrates an example of morphing a first image 500 into a second image 520, wherein in the first image 500 color 502 is selected for a first light source (represented by a circle) and color 504 is selected for a second light source (represented by a triangle), and wherein in the second image 520 color 522 is selected for the first light source and color 524 is selected for the second light source. FIG. 5 further illustrates an intermediate image 510, wherein intermediate colors 512 and 514 are determined based on the color information of the intermediate image 510 for the first and second light sources, respectively.

Figure 6:
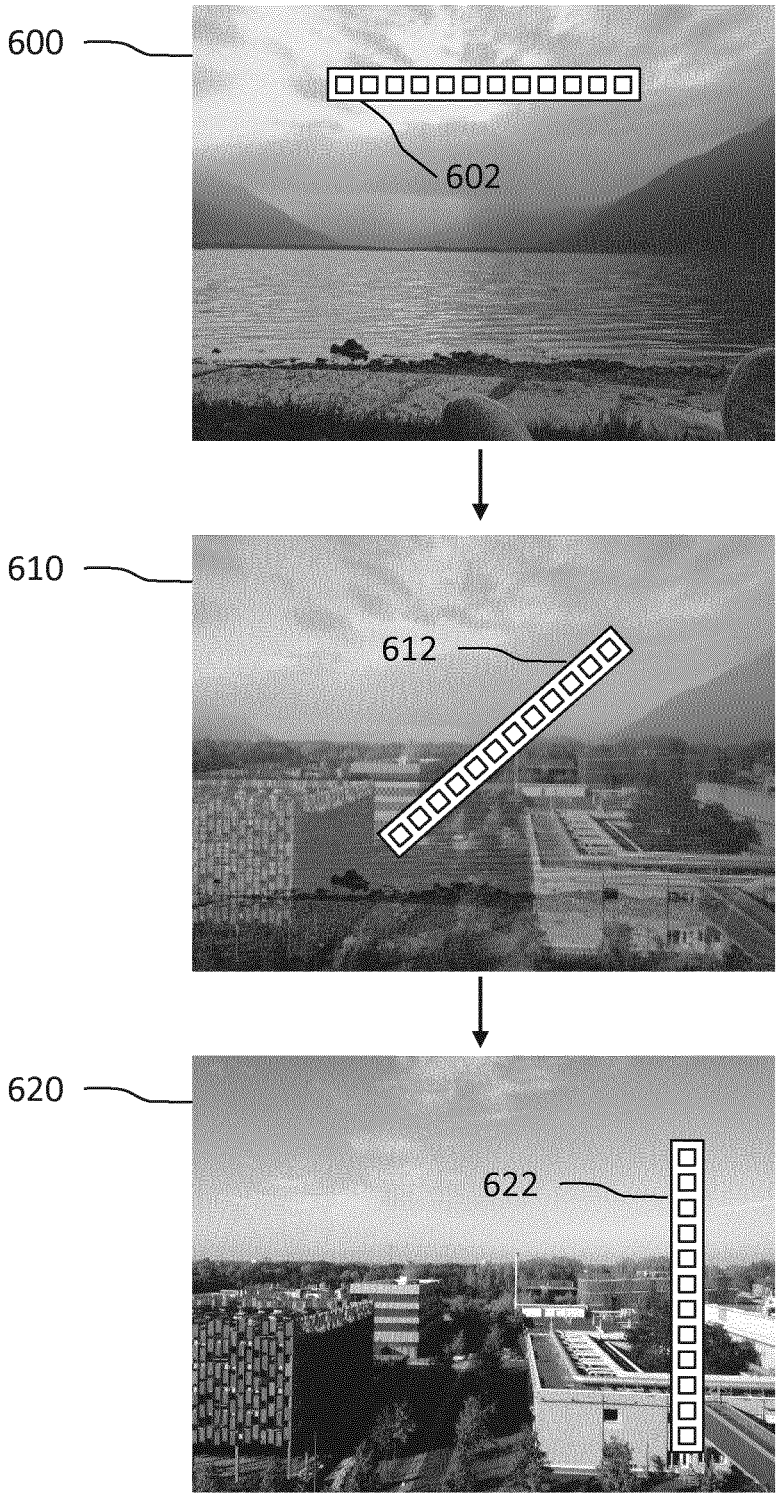
FIG. 6 shows an example of morphing a first image into a second image, and a graphical representation of a linear lighting device.

FIG. 6 shows an example of a graphical representation 602, 612, 622 of a linear lighting device (a lighting device with a plurality of light sources, for example an LED strip). In the first image 600, graphical representation 602 shows that each of the light sources of the linear lighting device is located at a different location in the image 600. In the second image 620, the graphical representation 622 of the linear lighting device is located at a different location from the graphical representation 602 in the first image 600. The graphical representation 622 has also been rotated 90 degrees (which rotation may be the result of a user input). Because of this rotation, the processor may determine that, in intermediate image 610, graphical representation 612 is rotated 45 degrees. In this example, each light source is controlled by the processor according to the color of the location of the light source in the first, intermediate and second image sequentially over the period of time.

Figure 7:
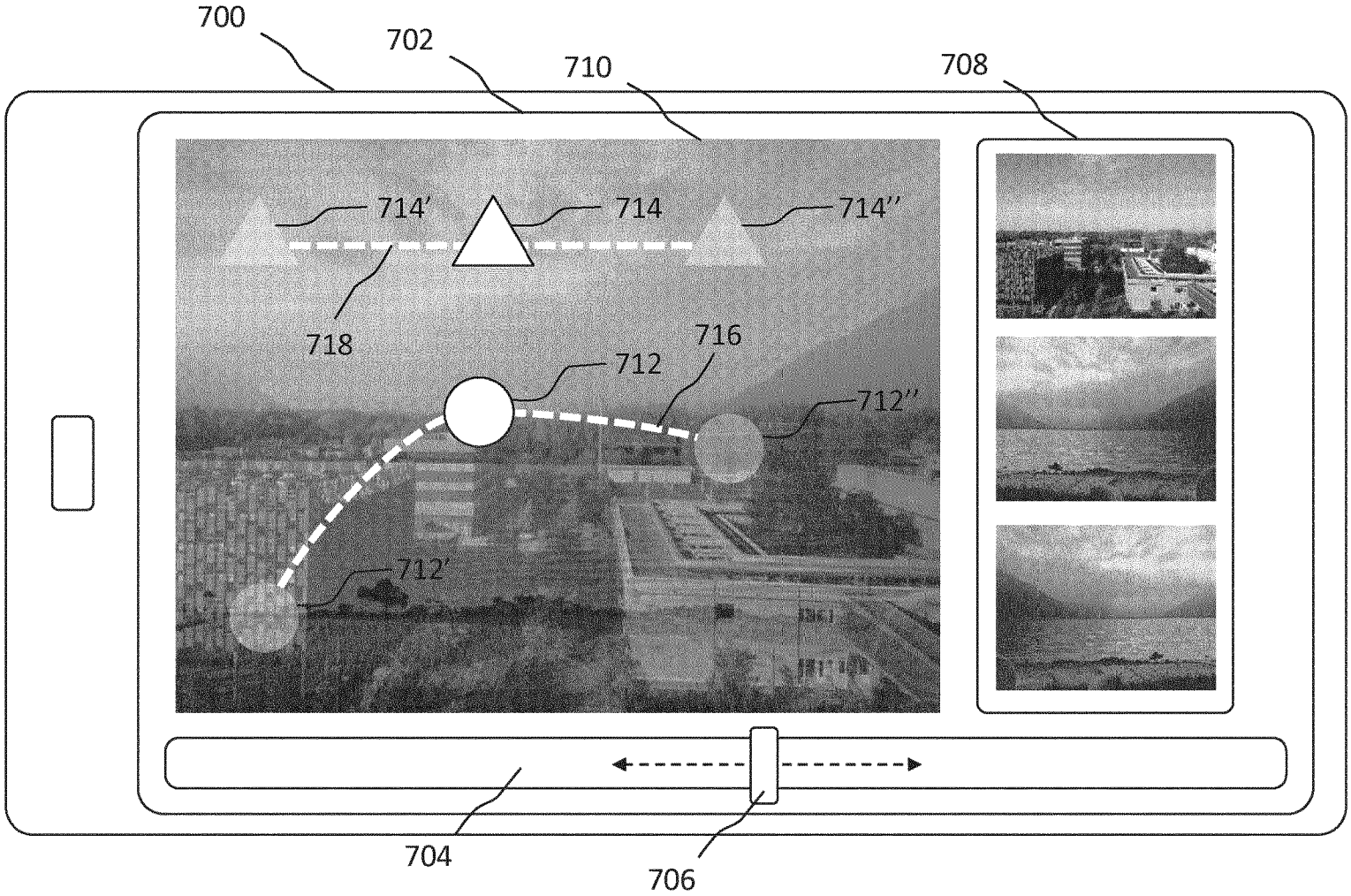
FIG. 7 shows an example of a controller comprising a user interface as an input unit for creating a dynamic light effect.

FIG. 7 shows an example of a controller 700 comprising a user interface as the input unit for creating a dynamic light effect. The user interface (in this example embodied as a touch display 702) comprises a first area 710 wherein the morphing of the first image into the second image is displayed. The first area 710 further shows a first path 716 along which the graphical representation 712 of a first light source moves during the morphing. The first area 710 further shows a second path 718 along which the graphical representation 714 of a second light source moves during the morphing. The first area 710 further shows the starting point of the graphical representations (712' and 714') and the end points of the graphical representations (712" and 714"). The user interface further comprises second area comprising a slider 706 on a timeline 704 of the dynamic light effect. A user may control the slider in order to select, for example, an intermediate image. Upon selecting the intermediate image, the user may, for example, reposition the graphical representation 712, 714 or the path 716, 718 of any of the light sources by, for example, selecting and dragging the graphical representation 712, 714 or the path 716, 718 to the new position. The user interface further comprises a third area 708 wherein a plurality of images are shown. A user may select, via the touch display, one on the images as the first image, as an intermediate image or as the second image.

The processor 106 may be further arranged for controlling the light output of the at least one light source 110 while a user is creating the dynamic light effect or adjusting any parameter of the dynamic light effect. This may be useful, because it provides a real time preview of the light effect.

The processor 106 may be further arranged for generating a snapshot of any image (e.g. a first image, a second image, an intermediate image) or any selected color in any of the images. The processor may, for example, generate the snapshot when a dedicated user input is received via the input unit. This is advantageous because it allows a user to save, for example, an intermediate image or an intermediate color selection, which may be (later) selected to generate a static light effect (i.e. a light effect that does not change over time).

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processing unit. In the device claim enumerating several means, several of these means may be embodied by one and the same item of hardware. The mere fact that certain measures are recited in mutually different dependent claims does not indicate that a combination of these measures cannot be used to advantage.

Aspects of the invention may be implemented in a computer program product, which may be a collection of computer program instructions stored on a computer readable storage device which may be executed by a computer. The instructions of the present invention may be in any interpretable or executable code mechanism, including but not limited to scripts, interpretable programs, dynamic link libraries (DLLs) or Java classes. The instructions can be provided as complete executable programs, partial executable programs, as modifications to existing programs (e.g. updates) or extensions for existing programs (e.g. plugins). Moreover, parts of the processing of the present invention may be distributed over multiple computers or processors.

Storage media suitable for storing computer program instructions include all forms of nonvolatile memory, including but not limited to EPROM, EEPROM and flash memory devices, magnetic disks such as the internal and external hard disk drives, removable disks and CD-ROM disks. The computer program product may be distributed on such a storage medium, or may be offered for download through HTTP, FTP, email or through a server connected to a network such as the Internet.

The invention claimed is:

1. A controller for controlling a light source, the controller comprising: a communication unit for communicating with the light source, an input unit for receiving a first input indicative of a selection of a first color in a first image, and for receiving a second input indicative of a selection of a second color in a second image, wherein the first and second input are from a user or a device; and a processor for morphing the first image into the second image after the first and second input have been received, whereby at least one intermediate image in between the first image and the second image is generated, the at least one intermediate image being a mixture of the first image and the second image, and for determining at least one intermediate color based on color information of the at least one intermediate image, and for controlling the light output of the light source according to the first color, the at least one intermediate color and the second color sequentially over a period of time, by communicating the first color, the at least one intermediate color and the second color to the light source to create a dynamic light effect by selecting the first color and the second color in the first and second images.

2. The controller of claim 1, wherein the controller further comprises a display arranged for displaying the morphing of the first image and the first color into the second image and the second color over time.

3. The controller of claim 2, wherein the processor is further arranged for providing, on the display, a graphical representation of the light source in the first, the at least one intermediate and the second image, wherein the graphical representation of the light source is located at the first, the at least one intermediate and the second color, respectively.

4. The controller of claim 3, wherein the input unit is arranged for receiving user input related to a repositioning of at least one of the graphical representation in the first, the at least one intermediate and the second image, which repositioning is representative of a selection of the color of at least one of the first, the at least one intermediate and the second image.

5. The controller of claim 1, wherein the first color is associated with a first set of coordinates in the first image, and wherein the second color is associated with a second set of coordinates in the second image, and wherein the processor is arranged for:

determining a path which starts at the first set of coordinates and ends at the second set of coordinates;

determining an intermediate set of coordinates on the path in the at least one intermediate image; and determining the at least one intermediate color based on color information at the intermediate set of coordinates in the at least one intermediate image.

6. The controller of claim 5, wherein the input unit is arranged for receiving user input related to a repositioning of at least a part of the path.

7. The controller of claim 1, wherein the input unit is arranged for receiving color information of a light setting from the light source as the first input, and wherein the processor is arranged for selecting the first color in the first image based on the received color information, such that the first color corresponds at least partially to the color information.

8. The controller of claim 1, wherein the input unit is arranged for receiving user input related to the selection of the first color in the first image or the selection of the second color in the second image.

9. The controller of claim 8, wherein the input unit is arranged for receiving user input related to a selection of the first image or the second image from a plurality of images.

10. A method of controlling a light source, the method comprising:

receiving a first input indicative of a selection of a first color in a first image, wherein the first input is from a user or a device;

receiving a second input indicative of a selection of a second color in a second image, wherein the second input is from the user or the device;

morphing the first image into the second image after receiving the first and second input, whereby at least one intermediate image in between the first image and the second image is generated, the at least one intermediate image being a mixture of the first image and the second image;

determining at least one intermediate color based on color information of the at least one intermediate image; and controlling light output of the light source according to the first color, the at least one intermediate color and the second color sequentially over a period of time, by communicating the first color, the at least one intermediate color and the second color to the light source to create a dynamic light effect by selecting the first color and the second color in the first and second images.

11. The method of claim 10, further comprising providing a graphical representation of the light source in the first, the at least one intermediate and the second image, wherein the graphical representation of the light source is located at the first, the at least one intermediate and the second color, respectively.

12. The method of claim 11, further comprising receiving a user input related to a repositioning of at least one of the graphical representation in the first, the at least one intermediate and the second image, which repositioning is representative of a selection of the color at least one of the first, the at least one intermediate and the second image.

13. The method of claim 10, wherein receiving the first input comprises receiving a first user input; and wherein receiving the second input comprises receiving a second user input.

14. A computer program product for a computing device, the computer program product comprising computer program code to perform the method of claim 10, when the computer program product is run on a processing unit of the computing device.

* * * * *